US008353636B2

(12) United States Patent
Drugeon et al.

(10) Patent No.: US 8,353,636 B2
(45) Date of Patent: Jan. 15, 2013

(54) SUPPORT DEVICE FOR A COSMETIC ARTICLE AND ASSOCIATED METHOD

(75) Inventors: Lionel Drugeon, La Garenne Colombes (FR); Stephane Maire, Bry sur Marne (FR)

(73) Assignee: L'Oreal, Paris (FR)

( * ) Notice: Subject to any disclaimer, the term of this patent is extended or adjusted under 35 U.S.C. 154(b) by 526 days.

(21) Appl. No.: 12/707,631

(22) Filed: Feb. 17, 2010

(65) Prior Publication Data

US 2010/0209172 A1 Aug. 19, 2010

Related U.S. Application Data

(60) Provisional application No. 61/165,981, filed on Apr. 2, 2009.

(30) Foreign Application Priority Data

Feb. 17, 2009 (FR) ..... 09 51025

(51) Int. Cl.
*B43K 7/12* (2006.01)

(52) U.S. Cl. ..... 401/107

(58) Field of Classification Search ..... 401/99, 401/102, 107

See application file for complete search history.

(56) References Cited

U.S. PATENT DOCUMENTS

| | | | | |
|---|---|---|---|---|
| 3,359,992 | A * | 12/1967 | Cishek et al. | 401/101 |
| 5,352,054 | A * | 10/1994 | Lhuisset | 401/269 |
| 7,874,753 | B2 * | 1/2011 | Domy et al. | 401/99 |
| 2006/0285911 | A1 | 12/2006 | Demellier | |

FOREIGN PATENT DOCUMENTS

| | | | |
|---|---|---|---|
| DE | 20 2008 010757 | | 11/2008 |
| EP | 1 468 624 | A1 | 10/2004 |
| FR | 2 865 910 | | 8/2005 |
| FR | 2 871 712 | A1 | 12/2005 |

* cited by examiner

*Primary Examiner* — Huyen Le
(74) *Attorney, Agent, or Firm* — Connolly Bove Lodge & Hutz LLP

(57) ABSTRACT

This device comprises a covering (12) which defines an internal cavity (22) and a body (14) which can be moved in a first direction relative to the covering (12) between a storage position and a position in which the body (14) is removed from the covering.

The device comprises a pushing member (54) which is mounted so as to be able to move relative to the covering (12) in the first direction between an idle position and a configuration for moving the body towards the removal position thereof.

The device comprises a releasable assembly (80; 64) for retaining the body in the storage position thereof, and a member (56) for resiliently urging the pushing member (54) towards the idle position thereof.

15 Claims, 8 Drawing Sheets

SUPPORT DEVICE FOR A COSMETIC ARTICLE AND ASSOCIATED METHOD

The present invention relates to a support device for a cosmetic article, of the type comprising:

a covering which defines an internal cavity;

a body for receiving a cosmetic article, the body being able to be moved in a first direction along a longitudinal axis relative to the covering from a position in which the body is stored in the covering and in which the body is arranged at least partially in the internal cavity towards a position in which the body is removed from the covering;

a pushing member which is mounted so as to be movable relative to the covering in the first direction along the longitudinal axis from an idle configuration towards a configuration for moving the body towards the removal position thereof.

The term "cosmetic product" is intended to refer in particular to a product as defined in the EC Council Directive 93/35 of 14 Jun. 1993.

The term "cosmetic article" is intended to refer to an object or a tool which is intended to support or receive in a temporary or permanent manner a cosmetic product in order to be applied to the skin or the keratin fibres of a human being or animal, or a block of self-supporting cosmetic product.

The device according to the present invention is intended to be used in particular to receive and dispense a cosmetic product which is packaged in the form of a block, such as a "baton" or lipstick, a lip care product, a foundation, a cheek colour, a concealer, a treatment or moisturising composition, a hair care product, or a deodorant, in order to be applied directly to the skin or the keratin fibres of a human being or animal.

In a variant, the device according to the present invention is intended to contain a receptacle which receives a liquid cosmetic product, such as a cream, a perfume, an emulsion, the liquid product being intended to be applied by means of spraying on the skin or the keratin fibres of a human being or animal.

In another variant, the device according to the invention is intended to contain a tool for applying a cosmetic product, such as a cosmetic product applicator, which is intended to be placed in contact with the cosmetic product.

In devices for applying cosmetic product in the form of a baton, such as a lipstick, it is known to mount the stick on a body comprising a tube for receiving the stick and a base for withdrawing the baton from the tube.

This body which is sometimes referred to as a "mechanism" is introduced into a covering which acts as a casing when the baton of cosmetic product is not used.

The covering is arranged around the tube containing the baton of cosmetic product and is pressed against the upper end of the base.

In order to use the baton of cosmetic product, the user grips the base using the fingers of a first hand, and grips the covering using the fingers of a second hand. The user completely removes the body from the covering by separating these elements.

Such a device is therefore complex to use, since it requires the simultaneous use of both hands. Furthermore, the external appearance thereof is not completely satisfactory, since the base of the body protrudes out of the covering.

An object of the invention is therefore to provide an application device which has a covering and a body for receiving a cosmetic article which can be readily removed from the covering, whilst having a very satisfactory external appearance.

To this end, the invention relates to a device of the above-mentioned type, characterised in that the device comprises:

an assembly for retaining the body in the storage position thereof, the retention assembly being able to be released by moving the pushing member from the idle configuration to the configuration thereof for moving the body; and a member for resiliently urging the pushing member towards the idle position thereof.

The device according to the invention may comprise one or more of the following features, taken in isolation or according to any technically possible combination:

in the storage position, the body is completely contained in the internal cavity, the device comprises a member for resiliently urging the body towards the removal position thereof, with the retention assembly retaining the body in the storage position thereof counter to the member for resiliently urging the body when the pushing member is in the idle position thereof;

the member for resiliently urging the body and the member for resiliently urging the pushing member are formed by a common resilient urging member stacked mechanically between the pushing member and the body;

the urging member of the body is separate from the urging member of the pushing member;

the device comprises an intermediate member which can be moved together with the body between the storage position and the removal position, the intermediate member being retained in the covering in the removal position, the body being able to be moved relative to the intermediate member in the removal position towards a position completely removed from the covering;

the intermediate member defines an abutment wall for the resilient urging member of the body;

the intermediate member delimits a housing for receiving the body, having a shape which is substantially complementary to at least a portion of the body, the intermediate member comprising releasable means for retaining the body in the intermediate member, arranged in the housing;

the covering extends longitudinally between an opening for handling the pushing member and an opening for removing the body, the pushing member being manoeuvred through the handling opening in order to move from the idle configuration to the pushing configuration, the body being removed via the removal opening when it moves from the storage position to the removal position thereof;

the retention assembly comprises a resilient lug which is fixedly joined to one of the covering and of an element which is movable together with the body, and an abutment surface of the lug which is delimited on the other of the covering and of the element which is movable together with the body, the lug being pressed on the abutment surface in the storage position, the movement of the pushing member from the idle configuration thereof towards the configuration thereof for moving the body causing the lug to move away from the abutment surface and the element which is movable together with the body to be released relative to the covering;

the device comprises a cosmetic article which is carried by the body, the cosmetic article being selected from a block of solid cosmetic product, a liquid and a tool for applying a cosmetic product;

the body is also movable from the removal position towards a position completely removed out of the covering, in which the body is totally separated from the covering;

the pushing member is movable relative to the body in the first direction along the longitudinal axis from the idle configuration to the configuration for moving the body;

the body delimits a supplying opening for supplying the cosmetic article, the supplying opening being located inside the internal cavity of the covering in the removal position, the supplying opening being located the covering in the completely removed position.

The device according to the invention may comprise one of the above features without necessarily comprising the feature by which in the removal position, the body is movable in a second direction opposite the first direction along the longitudinal axis as far as the storage position by applying pressure on the body.

The invention also relates to a method for using a cosmetic article, characterised in that it comprises the following steps:

providing a device as defined above, moving the pushing member in a first direction from the idle configuration thereof towards the configuration for moving the body, counter to the member for resiliently urging the pushing member towards the idle configuration thereof;

releasing the retention element of the body using the pushing member;

moving the body in the first direction from the storage position thereof towards the removal position thereof advantageously under the action of the member for urging the body towards the removal position thereof;

removing the body completely from the covering in order to use the cosmetic article.

The invention will be better understood from a reading of the following description, given purely by way of example and with reference to the appended drawings, in which.

A first application device 10 according to the invention is illustrated in FIGS. 1 to 8.

This first device 10 is intended to be used in particular to receive and dispense a cosmetic product which is packaged in the form of a block, such as a baton or lipstick, a lip care product, a foundation, a cheek colour, a concealer, a treatment or moisturising composition, a hair care product or a deodorant, in order to be applied directly to the skin or the keratin fibres of a human being or animal.

Figure 1:
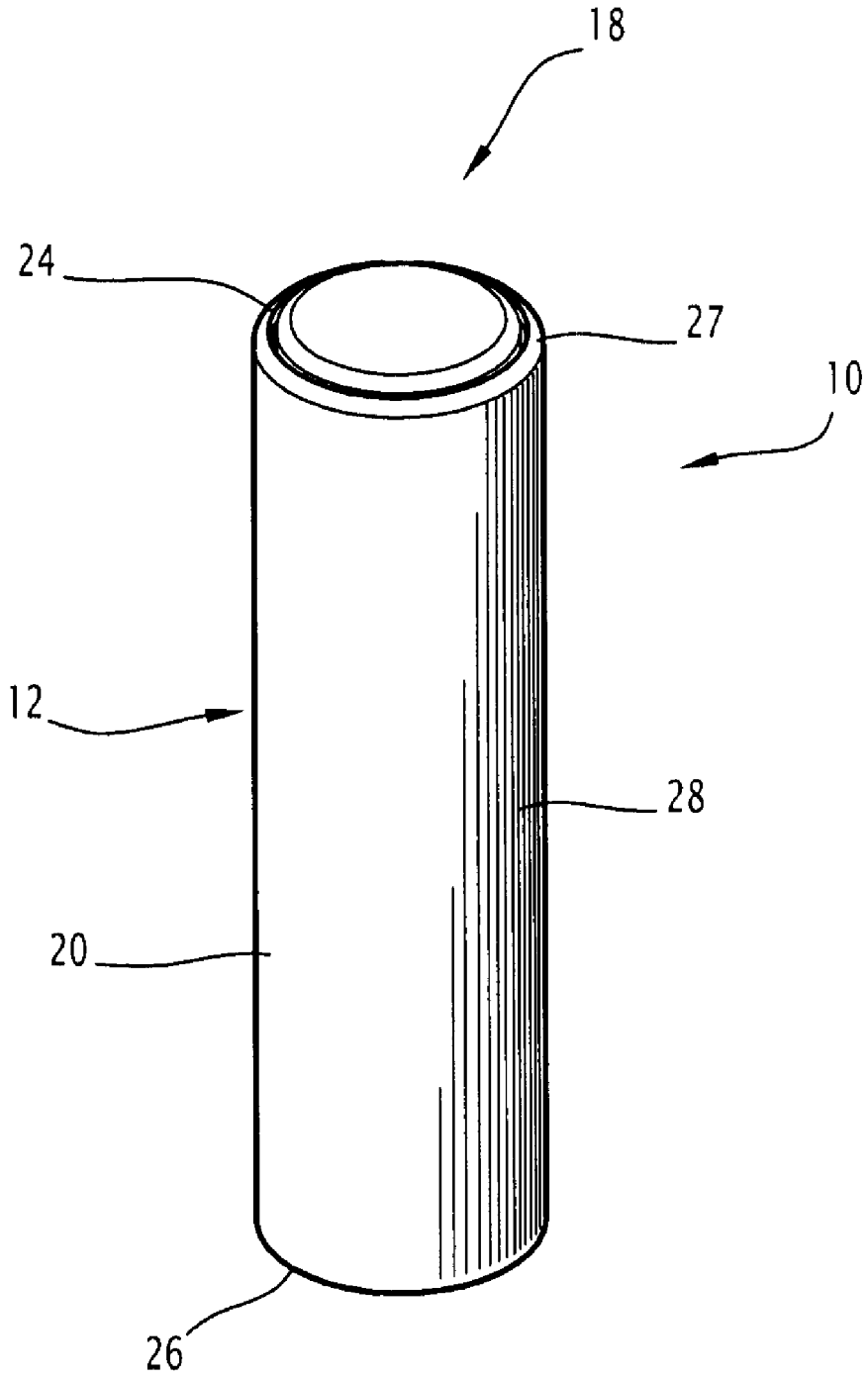
FIG. 1 is a perspective view of a first application device according to the invention in a position in which the body for receiving the cosmetic article is stored in the covering.

The first device 10 comprises an outer covering 12 which can be seen in FIG. 1, a body 14 for receiving a cosmetic article 16 and an assembly 18 for removing the body 14 from the covering 12.

Figure 2:
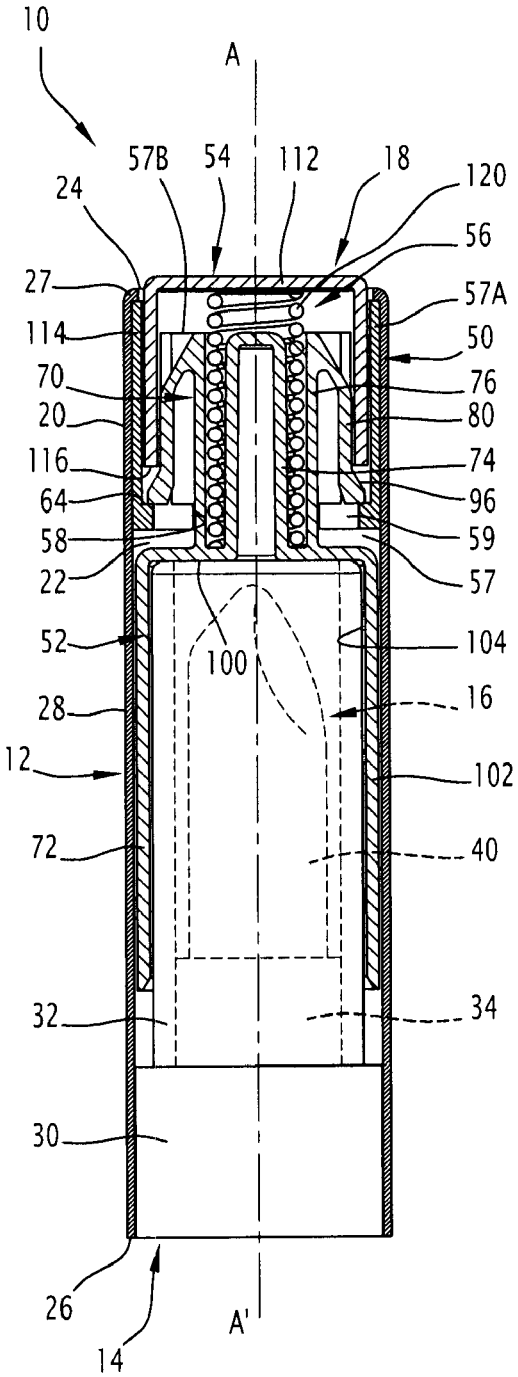
FIG. 2 is a sectioned view, taken along a vertical centre plane, of the device of FIG. 1.

In the example illustrated in FIG. 2, the covering 12 is formed by a hollow tubular element 20 having a longitudinal axis A-A', which is vertical in FIG. 2.

The tubular element 20 defines an internal cavity 22 for accommodating the body 14 and the removal assembly 18. The cavity 22 opens axially upwards in FIG. 2 via an opening 24 for handling the removal assembly 18 and opens axially downwards via an opening 26 for removing the body 14 and the cosmetic article 16.

In the following, the orientations selected are indicative and are intended to be understood in relation to the Figures. In particular, the terms "upper", "lower", "up" and "down" are intended to be understood in a relative manner in relation to the orientation selected in the Figures, the terms "upper" and "up" being intended to be understood generally as being closer to the handling opening 24, whilst the terms "lower" or "low" are intended to be understood as being closer to the removal opening 26. In practice, these orientations could be inverted.

The handling opening 24 is delimited externally by an annular edge 27 which protrudes towards the axis A-A' from the tubular element 20.

The internal cavity 22 extends over the entire length of the tubular element 20. In the example illustrated in FIGS. 1 and 2, the cross-section of the cavity 22 is circular and constant. In a variant, this cross-section may be of other shapes, such as a polygonal, square, triangular or oval shape. The cavity 22 may have a variable cross-section moving along the axis A-A'.

In this example, the covering 12 has an outer surface 20 which is substantially smooth in order to improve the external aesthetic appearance.

In the example illustrated in FIGS. 1 to 8, the body 14 forms a mechanism for removing the cosmetic article 16.

In this manner, the body 14 comprises a base 30, a tube 32 for receiving the cosmetic article 16 and a cup 34 which can be moved axially in the tube 32.

The base 30 has an outer section which is conjugate to the inner section of the cavity 22 delimited by the covering 20 in the region of the removal opening 26.

The tube 32 protrudes axially upwards in FIG. 2 from the base 30.

The cup 34 is arranged in the tube 32. It can be moved longitudinally in the tube 32 between a retracted position, arranged in the region of the base 30, and a deployed position, arranged remote from the base 30.

In known manner, various mechanisms exist for moving the cup 34 and the cosmetic article 16 in the tube 32 in order to remove the cosmetic article from the tube 32.

In a known example of a mechanism, the base 30 is mounted so as to rotate relative to the tube 32 in order to drive a helical assembly (not illustrated) having an axis A-A' for moving the cup 34 upwards. In a variant, a member for moving the cup 32 in translation along the axis A-A' is provided so as to be accessible by a user from the outer side of the tube 32.

Figure 3:
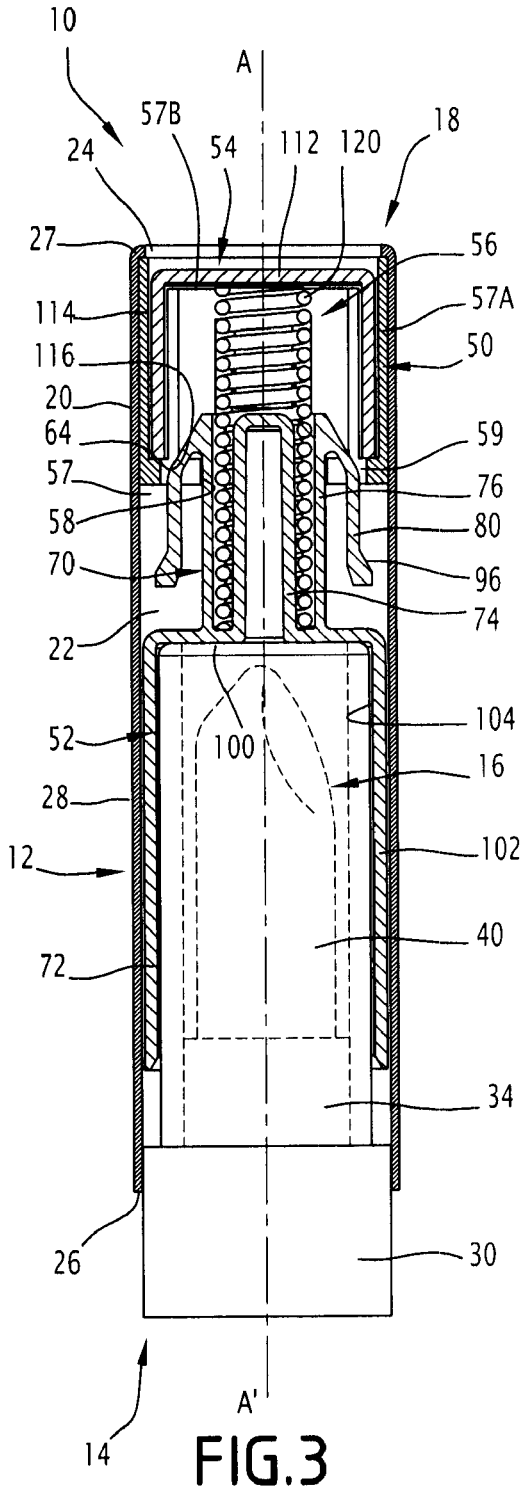
FIG. 3 is a view similar to FIG. 2, in which the body is in its position in which it is removed from the covering.
Figure 4:
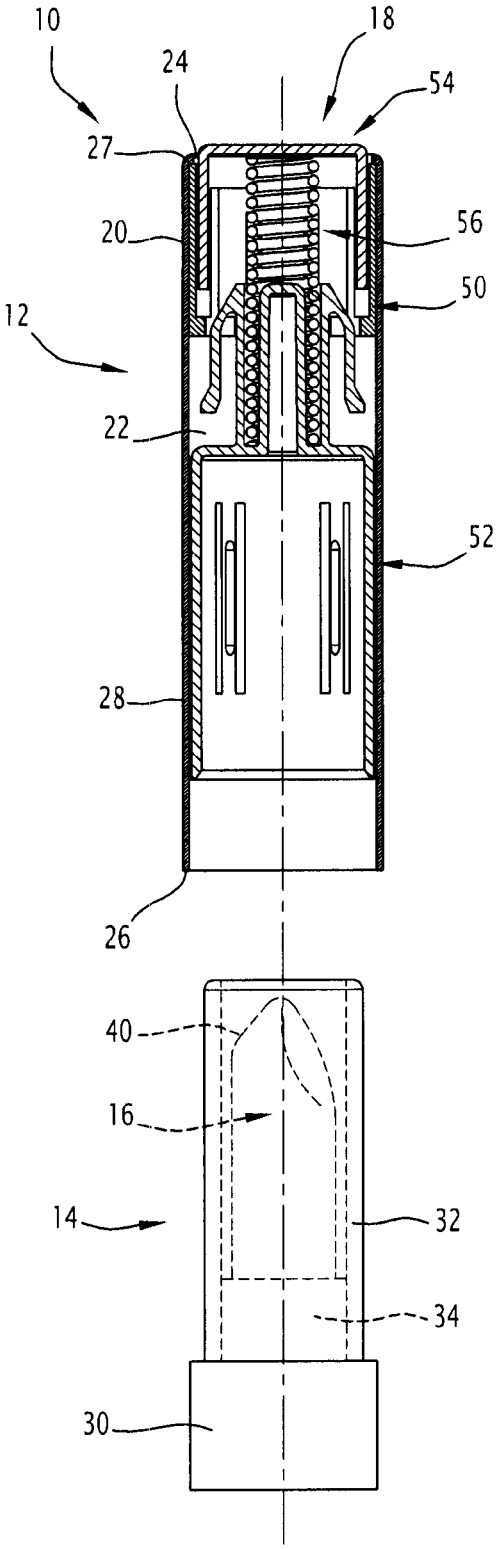
FIG. 4 is a view similar to FIG. 3, in which the body has been completely removed from the covering.

The body 14 can be moved along the axis A-A' in the covering 12 between a position in which the body is stored in the covering illustrated in FIG. 2, and a position in which the body is removed from the covering, illustrated in FIG. 3. It can further be moved from the removal position thereof to a position removed from the covering, illustrated in FIG. 4.

In the position in which the body is stored in the covering, the body 14 is substantially completely inserted in the cavity 22. The base 30 blocks the removal opening 26 and is level with the tubular element around this opening 26.

In the removal position, the body has been moved away from the handling opening 24 through the removal opening 26. The base 30 protrudes from the removal opening 26 in order to be gripped by the fingers of a user.

In the completely removed position, the body 14 is completely separated from the covering 12.

The cosmetic article 16 is formed by a baton 40 of cosmetic product, such as a lipstick. It is mounted so as to be fixedly joined to the cup 34. The baton 40 is solid so as to have autonomous mechanical strength at ambient temperature, for example, of 25° C., in the absence of any external retention.

In the retracted position of the cup 34, the baton 40 is completely received in the tube 32 and does not protrude out of this tube 32.

In the deployed position of the cup 34, the baton 40 protrudes from the tube 32 in order to allow cosmetic product to be applied to the skin or the keratin fibres of a user by means of contact between the baton 40 and skin or the keratin fibres.

The removal assembly 18 comprises a retention plate 50 which is mounted so as to be fixedly joined to the tubular element 20 in the region of the handling opening 24, an intermediate member 52 for moving the body 14 in the cavity 22, and a pushing member 54 in order to initiate the removal of the body 14 from the cavity 22.

The removal assembly 18 further comprises an urging member 56 which is interposed between the pushing member 54 and the intermediate member 52 in order to assist the removal of the intermediate member 52 and the body 14 from the covering and to return the pushing member 54, and an assembly for retaining the intermediate member 52 and the body 14.

The plate 50 is mounted in a fixed manner in the covering 12 with external abutment against the tubular element 20. It abuts upwards against the retention edge 27 which delimits the handling opening 24.

Figure 6:
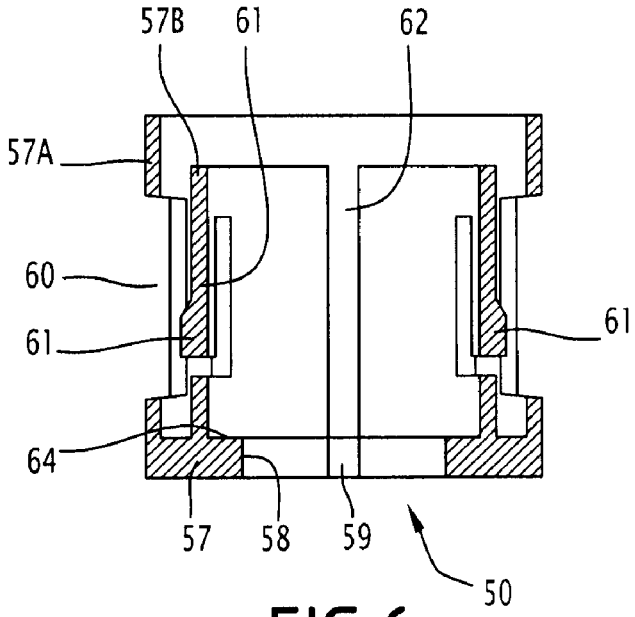
FIG. 6 is a sectioned view along a vertical centre plane of the plate for retaining the body in the device of FIG. 1.
Figure 7:
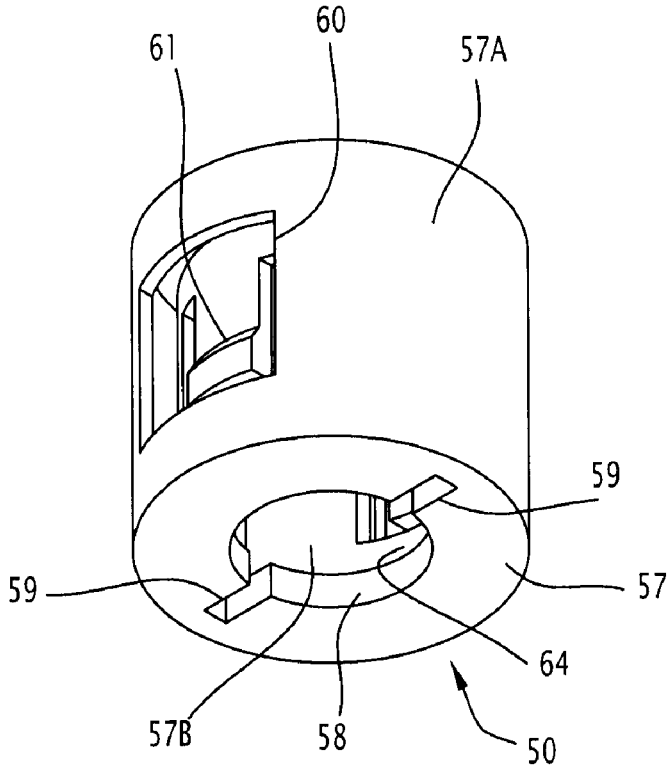
FIG. 7 is a perspective partial bottom view of the plate illustrated in FIG. 6.

With reference to FIGS. 6 and 7, the plate 50 comprises a transverse abutment wall 57, an external peripheral wall 57A, and an internal peripheral wall 57B. The walls 57A, 57B are cylindrical having an axis A-A' and protrude towards the handling opening 24 from the transverse abutment wall 57.

The transverse abutment wall 57 extends substantially perpendicularly relative to the axis A-A'. It defines a central through-opening 58 having an axis A-A' and two opposing notches 59 which radially extend the opening 58 at one side and the other of a centre plane which extends through the axis A-A'.

The external wall 57A delimits two opposing lateral apertures 60 which are offset angularly by substantially 90° relative to the notches 59 around the axis A-A'. The external wall 57A has an external cross-section which is smaller than the internal cross-section of the cavity 22.

The internal wall 57B delimits, opposite the lateral apertures 60, two U-shaped through-recesses which extend around a flexible stop 61 which protrudes radially towards the external wall 57A.

The internal wall 57B further defines, above the notches 59, two axial slots 62 for passage of the retention elements as will be described below. Each axial slot 62 opens axially upwards and downwards.

The transverse abutment wall 57 defines a transverse abutment surface 64, in which the central opening 58 and the notches 59 open. The abutment surface 64 is directed towards the handling opening 24.

The intermediate member 52 comprises, from bottom to top in FIGS. 2 to 5, a head 70 which is partially inserted in the plate 50 and a lower case 72 which protrudes towards the removal opening 26 from the head 70.

Figure 8:
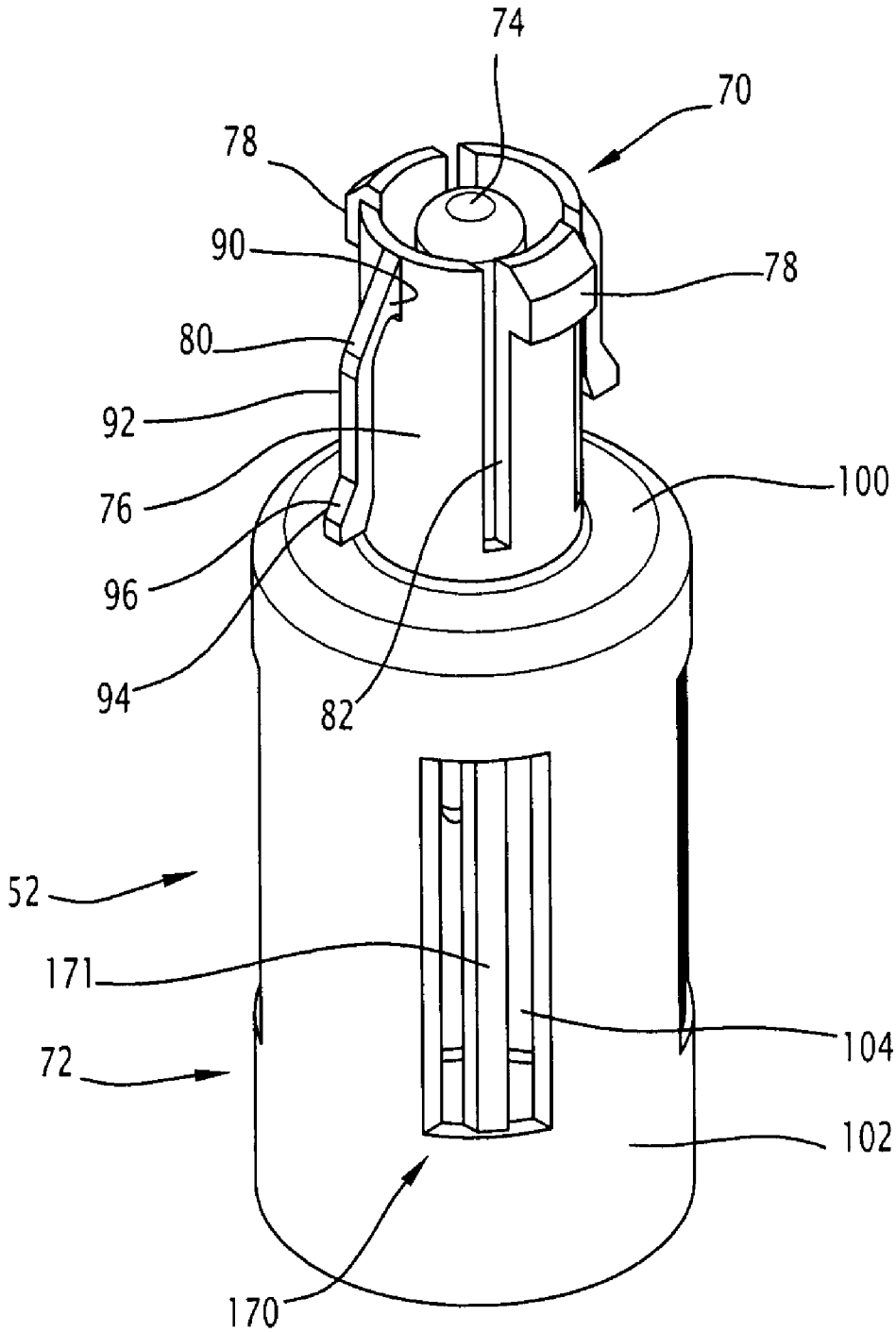
FIG. 8 is a three-quarter front perspective view of the intermediate member for moving the body in the device of FIG. 1.

The head 70 comprises an internal rod 74 for guiding the urging member 56, an external wall 76 for supporting the retention mechanism 56A and stops 78 for retaining the intermediate member 52 in the covering 12. As illustrated in FIG. 8, the head 70 further comprises retention lugs 80 which protrude radially outwards and away from the external wall 76.

The internal rod 74 extends along the axis A-A' towards the handling opening 24 from the case 72. It is blocked at the free end thereof.

The external wall 76 has an external cross-section which is substantially conjugated to the internal cross-section of the central opening 58 defined in the transverse wall 57.

The retention stops 78 extend radially away from the axis A-A' from the upper edge of the external wall 76. The external wall 76 delimits, at one side and the other of each stop 78, two longitudinal notches 82 which allow forced insertion of the retention stops 78 in the plate 50, through the central opening defined in the transverse wall 57.

When the stops 78 are received in the plate 50, they are offset angularly about the axis A-A' by approximately 90° relative to the notches 59.

In the example illustrated in FIG. 8, the head 70 comprises two removable retention lugs 80 which are arranged at one side and the other of a centre plane which extends through the axis A-A' and are angularly offset by approximately 90° relative to the retention stops 78.

More generally, the number of lugs 80 is greater than or equal to 1 and is, for example, between 1 and 10.

Each lug 80 comprises, from bottom to top in FIG. 8, an inner end 90 which is fixed to the outer wall 76 in the region of the upper end thereof, an intermediate portion 92 which extends axially away from the intermediate wall 76 and a free end which forms a retention stud 94.

The stud 94 has a bevelled outer surface 96 which is capable of co-operating with the lower edge of the pushing member 54, as will be seen below.

The case 72 comprises a base wall 100 and a lateral wall 102 which internally delimit an axial housing 104 for receiving at least a portion of the body 14.

The base wall 100 carries the head 70 which protrudes towards the handling opening 24.

The lateral wall 102 protrudes towards the removal opening 26 in the opposite direction to the head 70 from the base wall 100. It has an internal cross-section which is substantially conjugated to the internal cross-section of the covering 28 and an internal cross-section which is substantially connected to the external cross-section of the tube 32.

The length, taken along the axis A-A' of the lateral wall 102 is greater than the length of the head 70. This length is further less than the length of the body 14.

The housing 104 opens axially in a first direction towards the removal opening 26. It is at least partially axially blocked in the second direction towards the handling opening 24 by the base wall 100.

The intermediate member 52 can be moved together with the body 14 between the storage position and the removal position.

When the body 14 occupies the storage position thereof, the head 70 is substantially completely arranged in the plate 50. The case 72 extends relatively away from the removal opening 76.

The lugs 80 are inserted into the slots 62 which are provided in the internal wall 57B and the studs 94 thereof are pressed against the upper abutment surface 64. The co-operation between the lugs 80 and the abutment surface 64 prevents the movement of the intermediate member 52 and the body 14 in the first direction.

In the removal position, the lugs 80 have been retracted from the plate 50 through the notches 59.

The studs 94 are located in the cavity 22 below the plate 50 and the case 72 is located relatively close to the removal opening 26.

The lugs 80 which are fixedly joined to an element which can be moved together with the body 14 between the storage position and the removal position, and the abutment surface 64, which is fixedly joined to the covering, thereby form the releasable assembly for retaining the body 14 in the storage position thereof.

Figure 5:
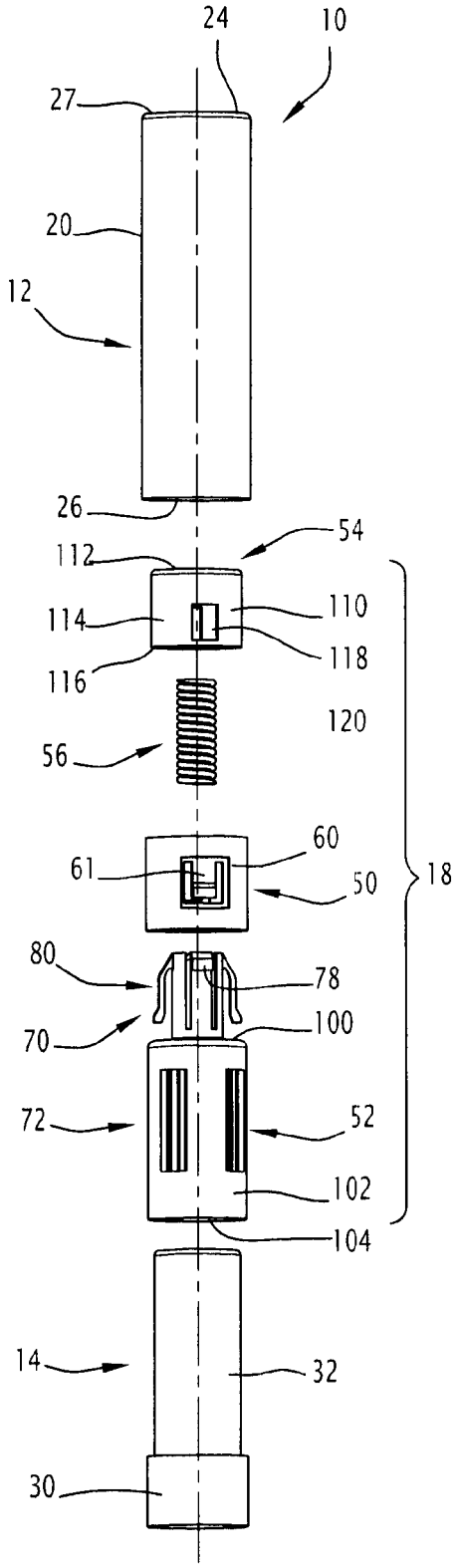
FIG. 5 is an exploded side view of the various elements which constitute the device of FIG. 1.

As illustrated in FIG. 5, the pushing member 54 is formed by a hollow cylindrical push-button 110 which is partially inserted into the cavity 22 through the handling opening 24.

The button 110 has an upper abutment wall 112 which is substantially perpendicular relative to the axis A-A', and a lateral wall 114 which protrudes downwards from the periphery of the abutment wall 112, and is arranged between the internal wall 57B and the external wall 57A of the plate 50.

The lateral wall 114 delimits a lower edge 116 which is capable of co-operating with the chamfered outer surface 96 of the lugs 80, as will be seen below.

The lateral wall 114 delimits apertures 118 which internally receive the radial stops 61 which protrude from the internal wall 57B.

The button 110 can be moved along the axis A-A' between an idle configuration illustrated in FIG. 2 and a configuration for activating the movement of the body towards the removal position thereof, illustrated in FIG. 3.

The pushing member 54 can be moved relative to the body in the first direction along the longitudinal axis A-A' from the idle configuration towards the configuration for moving the body.

In the idle configuration, in the example illustrated in FIG. 2, the button 110 protrudes slightly outwards from the cavity 22 through the handling opening 24. In a variant, it is arranged inside the cavity 22 in the region of the handling opening 24.

The lower edge 116 is arranged above and remote from the chamfered external surface 96.

In the idle configuration, the stop 61 is pressed against a lower edge of the aperture 118 in order to retain the push-button 110.

In the configuration for activating the movement of the body, the abutment wall 112 and the lateral wall 114 have been pushed into the covering 12 in the first direction towards the removal opening 26 in order to place them completely in the internal cavity 22.

The lower edge 116 has moved the lugs 80 radially inwards by pressing against the chamfered external surface 96. It is arranged in abutment against the upper surface 64 of the plate 70.

In the example illustrated in FIG. 2, the urging member 56 forms both a member for urging the pushing member 54 towards the idle position thereof and a member for urging the body 14 towards the removal position thereof.

In this manner, the common urging member 56 is stacked mechanically between the abutment wall 112 of the push-button 110 and the base wall 100 of the case 72.

The member 56 is formed, for example, by a helical spring 120 which is arranged in the head 70 in the external wall 76 around the rod 74.

When the body 14 and the intermediate member 52 occupy the storage position of the body in the covering, the urging member 56 keeps the lugs 80 pressed against the abutment surface 64. Furthermore, the urging member 56 retains the pushing member 54 in the idle configuration thereof, and presses the radial stops 61 against the lower edge of the apertures 118.

The operation of the first device 10 according to the invention will now be described.

Initially, as illustrated in FIG. 2, the body 14 occupies the storage position thereof in the packaging. In this manner, the tube 32 is inserted into the housing 104 of the case 72. The body 14 is retained mechanically in the case 72.

As seen above, the body 14 is completely received in the internal cavity 22. The base 30 thereof is arranged so as to be recessed in the cavity 22 relative to the handling opening 26 or is flush with the tubular element 20 in the region of the handling opening 26.

The aesthetic appearance of the device 10 is therefore improved in the storage position, since it has a peripheral external surface which is substantially homogeneous and in one piece, as illustrated in FIG. 1.

When a user wishes to use the cosmetic product 16 contained in the body 14, he moves the pushing member 54 in the first direction of the idle position thereof to the configuration thereof for activating the movement of the body.

To this end, he presses on the abutment surface 112 in order to counteract the urging force of the urging member 56 and moves the abutment surface 112 towards the removal opening 26 in the first direction along the axis A-A'.

During this movement, the lateral wall 114 slides between the walls 57A, 57B of the plate 70 towards the removal opening 26. The lower edge 116 presses against the chamfered surface 96 and brings about the radial movement of the lugs 80 towards the axis A-A' by means of flexion.

The studs 94 move radially opposite the notches 59 and slide over the surface 58. When the studs 94 are completely arranged opposite the notches 59, the intermediate member 52 and the body 14 are axially free relative to the abutment surface 64.

The intermediate member 52 and the body 14 move axially along the axis A-A' in the first direction towards and through the removal opening 26.

The spring 120 which forms the urging member 56 is deployed towards the removal opening 26 and pushes the intermediate member 52 and the body 14 towards the removal position illustrated in FIG. 3, in which the base 30 of the body 14 can be gripped by the fingers of a user.

The user releases the abutment wall 112 of the urging member 54 which brings about, under the action of the urging member 56, the return of the urging member 54 towards its idle position retained by the plate 50.

In this position of the body 14, the user can completely remove the body 14 away from the covering 12 and deploy the cosmetic article 16 out of the tube 32 in order to apply cosmetic product to his/her skin or/and his/her keratin fibres.

To this end, the user may, for example, rotate the base relative to the tube 32 in order to move the cup 34 outwards or simply move the cup 34 using a specific member as described above.

When the user has finished using the cosmetic article 16, he retracts it inside the tube 32, then reinserts the tube 32 into the case 72. The body 14 is repositioned in the removal position thereof illustrated in FIG. 3.

The user applies pressure to the body 14 in order to move it in the second direction towards the handling opening 24 and retract the base 30 into the covering 12 as far as the storage position.

This movement of the body 14 brings about the joint movement of the intermediate member 52, the compression of the urging member 56 between the abutment wall 112 and the base wall 100, then the insertion of the retention lugs 80 through the notches 59 until the lugs 80 pass above the abutment surface 64 and are deployed radially away from the axis A-A' between the abutment surface 64 and the lower edge 116 of the pushing member 54.

Since the pushing member 54 is permanently urged towards the idle configuration thereof, the covering 12 retains a satisfactory aesthetic appearance regardless of the position of the body 14, and in particular when the body 14 is completely removed from the covering.

In a variant, the device 10 comprises a member for urging the pushing member 54 towards the idle position thereof, and a member for urging the body 12 towards the removal position thereof, separate from the member for urging the pushing member 54.

Such a device allows the forces applied by each of the urging members to the pushing member 54 and the assembly formed by the intermediate member 52 and the body 14, respectively, to be readily adjusted.

In another variant, the device 10 has no intermediate member. The body 14 is provided with retention means which can be released under the action of the pushing member.

Figure 9:
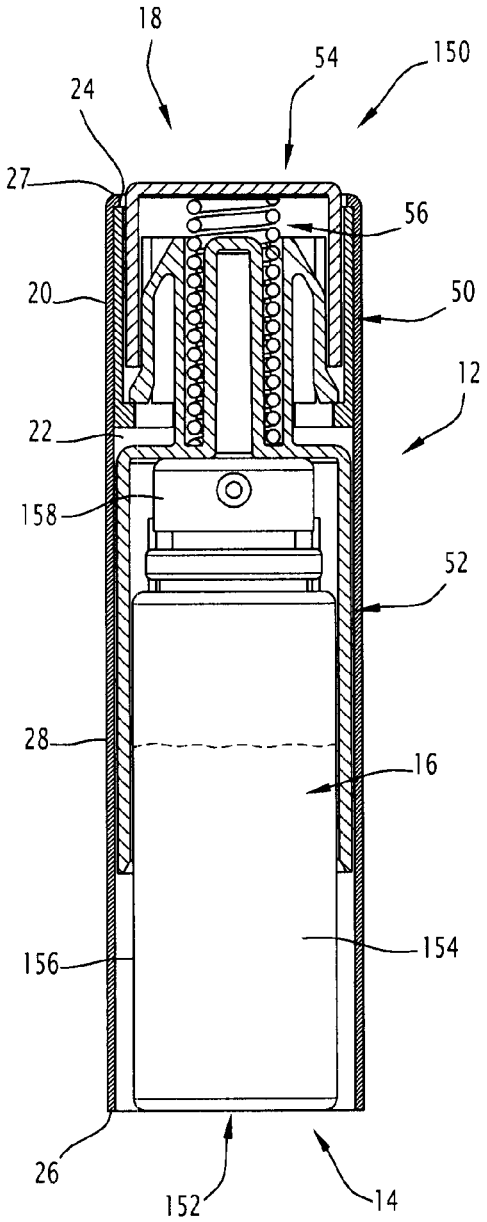
FIG. 9 is a view similar to FIG. 2 of a second device according to the invention.
Figure 10:
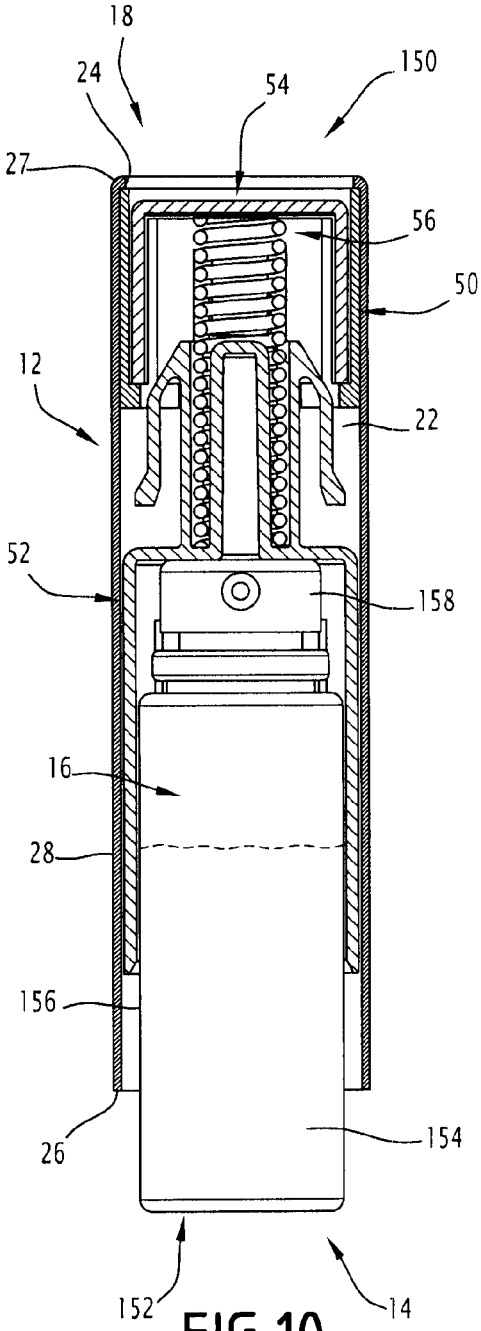
FIG. 10 is a view similar to FIG. 3 of the second device according to the invention.

A second device 150 according to the invention is illustrated in FIGS. 9 and 10. In contrast to the first device 10, the body 14 forms an assembly 152 for spraying a liquid cosmetic product 154. This assembly 152 comprises a bottle 156 which contains the cosmetic product 154 and a spray head 158 which are received in the case 72. The product 154 is, for example, a perfume.

The operation of the second device 150 is further similar to that of the first device 10.

Figure 11:
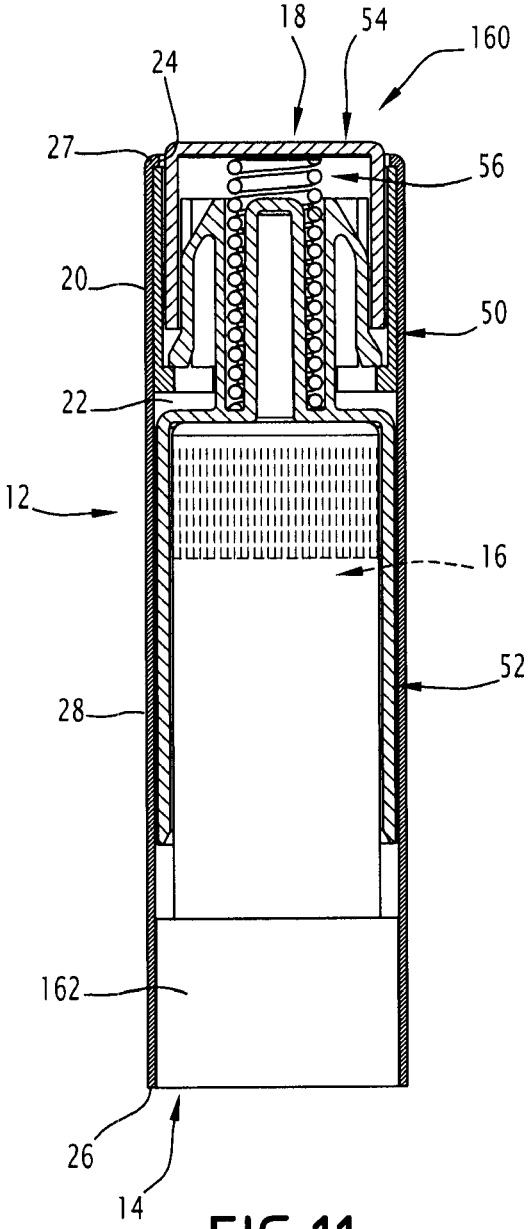
FIG. 11 is a view similar to FIG. 2 of a third device according to the invention.

A third device 160 according to the invention is illustrated in FIG. 11. In contrast to the first device 10, the body 14 forms a support for a tool for applying a cosmetic product, such as a brush, a fine brush, or more generally an applicator for a cosmetic product, provided with a foam, a felt, a frit, a woven fabric, a non-woven fabric, or a sponge, a fine brush, a brush having a twisted or injected core, or a comb, of porous thermoplastic material, a flocked end-piece, of a synthetic foam which covers a moulded portion or a spatula.

In a variant, the body 14 carries a cosmetic treatment tool, such as a rasp, a massage roller, a cuticle stick or a nail file.

In a variant illustrated in FIG. 8, which applies equally to the first device 10, the second device 150 and the third device 160, the device comprises complementary means 170 for retaining the body in the intermediate member 52 when the body 14 occupies the removal position thereof.

In the example of FIG. 8, the retention means 170 comprise resilient longitudinal blades 171 which partially protrude radially towards the axis A-A' in the housing 104 in order to grip the body 14. These blades 171 are advantageously integral with the wall 102.

Figure 12:
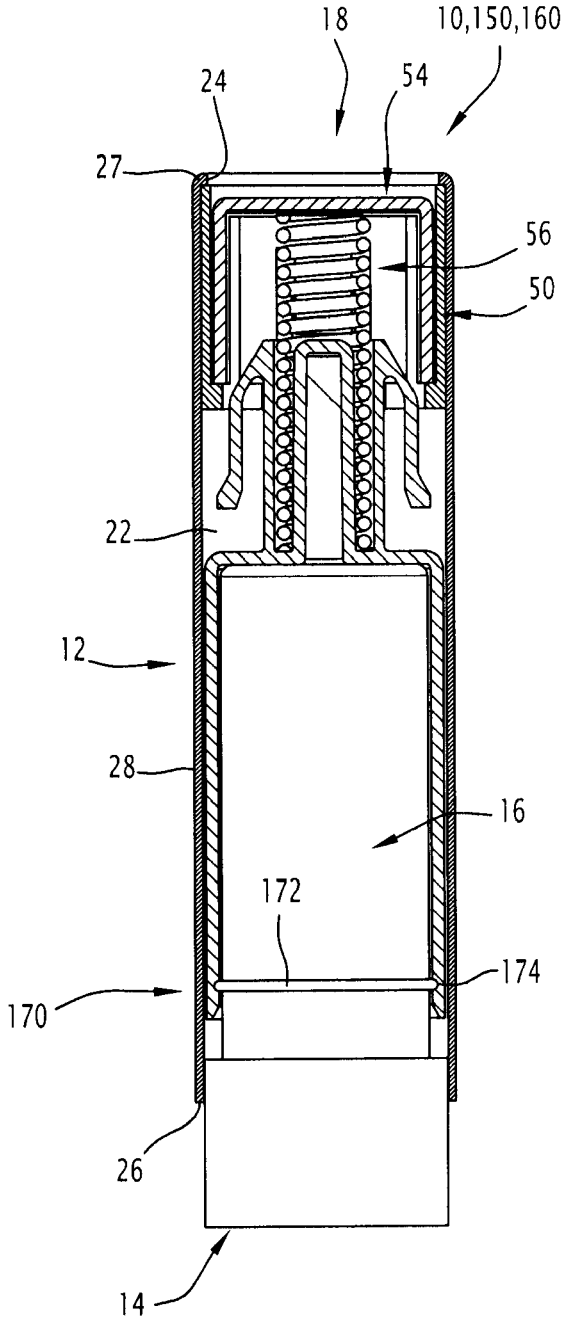
FIG. 12 is a detailed view of a second embodiment of the releasable means for retaining the body in the covering.

In a variant illustrated in FIG. 12, the retention means 170 comprise, for example, an annular flange 172 which protrudes radially outwards from the base 30 or the tube 32 and an annular groove 174 having a shape which is complementary to the flange 172. In the storage position, the flange 172 is received in the groove 174.

In this manner, when the body 14 and the intermediate member 52 move from the storage position of the body towards the removal position, the risk of ejecting the body 14 away from the intermediate member 52 is reduced, which prevents the untimely expulsion of the body 14 from the covering 12.

In this manner, the user readily controls the removal of the body 14 towards the position for use thereof by retracting the flange 172 from the groove 174.

Figure 13:
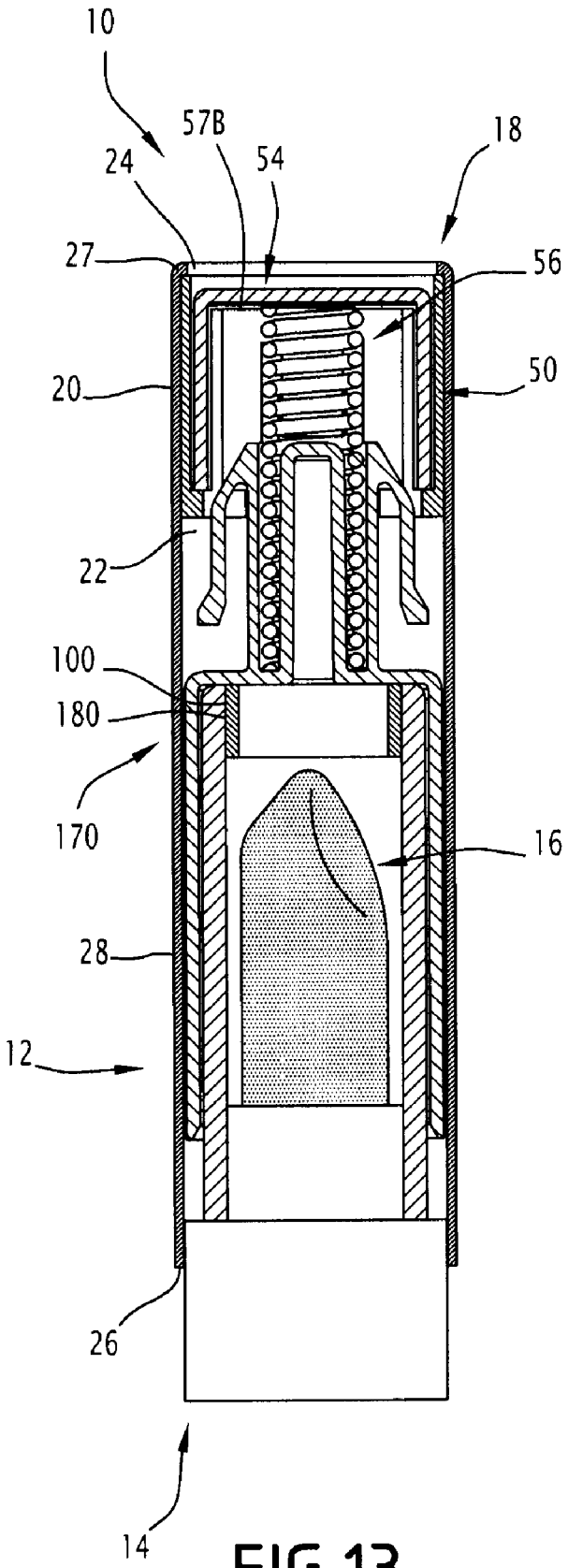
FIG. 13 is a view similar to FIG. 9 of another embodiment of the retention means of the body in the covering.

In the variant illustrated in FIG. 13, the retention means 170 comprise an internal retention wall 180 which is fixedly joined to the case 72. The internal retention wall 180 protrudes in the housing 104 towards the removal opening 26 away from the base wall 100.

The internal retention wall 180 has an external cross-section which is conjugated to the internal cross-section of the tube 32. In this manner, the retention wall 180 is inserted with force inside the tube 32, which limits the risk of untimely ejection of the body 14 from the covering 12 when moving from the storage position to the removal position.

With regard to FIGS. 2 and 3, as well as with regards to FIGS. 9 and 10, the pushing member 54 is movable relative to the body 14 in the first direction towards the removal opening 26 along longitudinal axis A-A', from the idle configuration towards the configuration for moving the body.

In a first part of the stroke of the pushing member 54 between the idle configuration and the configuration for moving the body, the retention assembly 80, 64 remains active to prevent the axial movement of body 14 and intermediate member 52 when applicable, from the storage position towards the removal position.

Then, in a second part of the stroke, the pushing member releases the retention assembly 80, 64 which authorizes the movement of body 14 and of intermediate member 52 when available, in the first direction from the storage position to the removal position.

The body 14 of support devices 10, 150, 160 comprises an internal storing space containing the cosmetic article 16.

The internal storing space is closed by a bottom. It opens through a supplying opening for the cosmetic article.

In the first device 10 as well as in the third device 160, the tube 32 opens through an axial supplying opening directed towards the handling opening 24. The tube 32 has a bottom directed towards the removal opening 26 in the storage position.

The baton 40 is removed through the supplying opening in its deployed position.

In the second device, the supplying opening opens transversally in the head 158. The cosmetic product located in the assembly 152 is supplied through the supply opening.

In devices 10, 150, 160, the body 14 is located in the covering 12 so that the supplying opening is relatively closer to the handling opening 24 and that the bottom is relatively closer to the removal opening 26.

As a consequence, in the removal position, the bottom of body 14 protrudes outside cavity 22 through the removal opening 26 in the first direction.

The supplying opening remains located inside cavity 22, and is unattainable for the user.

In order to reach the supplying opening, the user moves body 14 from its removal opening to its position completely removed with advantageously a rotation once it is removed out of the cavity 22 of body 12.

In another embodiment (not shown), the pushing member 54 comprises a cover, advantageously made of metal e.g. aluminium or of plastics, the cover covering the pushed-button 110 to improve the external appearance of the support device.

As it has been described above, when the body 14 occupies its removal position, it is movable in a second direction from the removal opening towards the handling opening along the longitudinal axis as far as its storage position, in particular by the user applying pressure on the body.

The handling of the pushing member 54 does not allow the return of the body 14 to its storage position inside internal cavity 22. This movement of the body is possible without actuation of the pushing member 54. The pushing member 54 is returned to its idle configuration by the pushing force applied directly on the body 14. The pushing force is transmitted to the pushing member 54 by the body 14.

The body 14 is movable from its storage position to its removal position by a movement which is exclusively in the first direction along the longitudinal axis A-A', without a movement in the second direction. The body is movable from its removal position to its storage position by a movement which is exclusively in the second direction opposite the first direction along axis A-A', without a movement in the first direction.

The invention claimed is:

1. Support device (10; 150; 160) for a cosmetic article, of the type comprising:

a covering (12) which defines an internal cavity (22);

a body (14) for receiving a cosmetic article (16), the body (14) being able to be moved in a first direction along a longitudinal axis (A-A') relative to the covering (12) from a position in which the body (14) is stored in the covering and in which the body (14) is arranged at least partially in the internal cavity (22) towards a position in which the body (14) is removed from the covering;

a pushing member (54) which is mounted so as to be able to move relative to the covering (12) in the first direction along the longitudinal axis (A-A') from an idle configuration towards a configuration for moving the body towards the removal position thereof;

characterised in that the device (10; 150; 160) comprises:

an assembly (80; 64) for retaining the body in the storage position thereof, the retention assembly (80; 64) being able to be released by moving the pushing member (54) from the idle configuration to the configuration thereof for moving the body; and a member (56) for resiliently urging the pushing member (54) towards the idle position thereof, and in that in the removal position, the body (14) is movable in a second direction opposite the first direction along the longitudinal axis as far as the storage position by applying pressure on the body (14).

2. Device (10; 150; 160) according to claim 1, characterised in that, in the storage position, the body (14) is completely contained in the internal cavity (22).

3. Device (10; 150; 160) according to either claim 1 or claim 2, characterised in that it comprises a member (56) for resiliently urging the body towards the removal position thereof, with the retention assembly (80; 64) retaining the body (14) in the storage position thereof counter to the member (56) for resiliently urging the body when the pushing member (54) is in the idle position thereof.

4. Device (10; 150; 160) according to claim 3, characterised in that the member for resiliently urging the body and the member for resiliently urging the pushing member are formed by a common resilient urging member (56) stacked mechanically between the pushing member (54) and the body (14).

5. Device according to claim 3, characterised in that the urging member of the body is separate from the urging member of the pushing member.

6. Device (10; 150; 160) according to claim 1, characterised in that it comprises an intermediate member (52) which can be moved together with the body (14) between the storage position and the removal position, the intermediate member (52) being retained in the covering in the removal position, the body (14) being able to be moved relative to the intermediate member (52) in the removal position towards a position completely removed from the covering (12).

7. Device (10; 150; 160) according to claim 6 comprises a member (56) for resiliently urging the body towards the removal position thereof, with the retention assembly (80; 64) retaining the body (14) in the storage position thereof counter to the member (56) for resiliently urging the body when the pushing member (54) is in the idle position thereof, characterised in that the intermediate member (52) defines an abutment wall (100) for the resilient urging member (56) of the body.

8. Device (10; 150; 160) according to claim 6, characterised in that the intermediate member (52) delimits a housing (104) for receiving the body, having a shape which is substantially complementary to at least a portion (32) of the body (14), the intermediate member (52) comprising releasable means (170) for retaining the body in the intermediate member, arranged in the housing (104).

9. Device (10; 150; 160) according to claim 1, characterised in that the covering (12) extends longitudinally between an opening (24) for handling the pushing member (54) and an opening (26) for removing the body, the pushing member (54) being manoeuvred through the handling opening (24) in order to move from the idle configuration to the pushing configuration, the body (14) being removed via the removal opening (26) when it moves from the storage position to the removal position thereof.

10. Device (10; 150; 160) according to claim 1, characterised in that the retention assembly comprises a resilient lug (80) which is fixedly joined to one of the covering (12) and of an element which is movable together with the body (14), and an abutment surface (64) of the lug which is delimited on the other of the covering (12) and of the element which is movable together with the body, the lug (80) being pressed on the abutment surface (64) in the storage position, the movement of the pushing member (54) from the idle configuration thereof towards the configuration thereof for moving the body causing the lug (80) to move away from the abutment surface (64) and the element which is movable together with the body to be released relative to the covering.

11. Device (10; 150; 160) according to claim 1, characterised in that it the body (14) is also movable from the removal position towards a position completely removed out of the covering, in which the body (14) is totally separated from the covering (12).

12. Device (10; 150; 160) according to claim 1, characterised in that in the storage position, the retention assembly (80; 64) prevents the movement of the body in the first direction.

13. Device (10; 150; 160) according to claim 1, characterised in that the pushing member (54) is movable relative to the body (14) in the first direction along the longitudinal axis (A-A')from the idle configuration to the configuration for moving the body.

14. Device (10; 150; 160) according to claim 1, characterised in that the body delimits a supplying opening for supplying the cosmetic article (16), the supplying opening being located inside the internal cavity (22) of the covering (12) in the removal position, the supplying opening being located outside the covering (12) in the completely removed position.

15. Method for using a cosmetic article, characterised in that it comprises the following steps:

providing a device (10; 150; 160) according to any one of the preceding claims;

moving the pushing member (54) in a first direction from the idle configuration thereof towards the configuration for moving the body, counter to the member (56) for resiliently urging the pushing member (54) towards the idle configuration thereof;

releasing the retention element (80; 64) of the body using the pushing member (54);

moving the body (14) in the first direction from the storage position thereof towards the removal position thereof;

removing the body (14) completely from the covering (12) in order to use the cosmetic article.

* * * * *